US005470537A

United States Patent [19]

Siegel

[11] Patent Number: 5,470,537

[45] Date of Patent: Nov. 28, 1995

[54] SUPPORTING STAND FOR CONICAL-BOTTOM LIMITED-VOLUME VIAL

[75] Inventor: Barney Siegel, Lawrenceville, Ga.

[73] Assignee: National Scientific Company, Lawrenceville, Ga.

[21] Appl. No.: 112,692

[22] Filed: Aug. 25, 1993

[51] Int. Cl.[6] ..... B01L 9/00

[52] U.S. Cl. ..... 422/104; 215/12.1; 215/395; 220/23.4; 220/23.86; 220/482; 220/699; 435/809

[58] Field of Search ..... 206/564; 211/71, 211/74; 248/311.2, 314; 422/104; 435/809; 215/12.1, 100 R; 220/23.4, 23.86, 356, 481, 482, 631, 636, 638, 699, 729, 724; 494/16, 20, 21, 44

[56] References Cited

U.S. PATENT DOCUMENTS

| | | | |
|---|---|---|---|
| 558,433 | 4/1896 | Stoddard | 422/104 X |
| 3,461,728 | 8/1969 | Paoli | 422/104 X |
| 3,464,567 | 9/1969 | Gowdy et al. | 211/74 |
| 3,521,785 | 7/1970 | Bergmann et al. | 422/104 X |
| 3,727,782 | 4/1973 | Doughty | 215/12.1 X |
| 3,902,477 | 9/1975 | Gevarde | 128/760 |
| 3,940,249 | 2/1976 | McClurg | 422/104 X |
| 4,074,824 | 2/1978 | Kontes | 215/12.1 X |
| 4,098,456 | 7/1978 | Bayham | 494/21 X |
| 4,484,907 | 11/1984 | Sheeran, Jr. | 211/74 X |
| 4,553,955 | 11/1985 | Lam et al. | 494/16 |
| 4,576,185 | 3/1986 | Proud et al. | 128/760 |
| 4,645,079 | 2/1987 | Hill | 206/564 X |
| 4,990,129 | 2/1991 | Nielson | 494/20 |
| 5,344,036 | 9/1994 | Stanesly et al. | 215/100 R X |

OTHER PUBLICATIONS

Seton Scientific Catalog 1987.
Fisher Scientific Catalog 1987 pp. 237–244.
Cole–Parmer Instrument Company Catalog 1992 p. 799.
Supelco Catalog 1994 pp. 592–601.

*Primary Examiner*—James C. Housel
*Assistant Examiner*—Arlen Soderquist
*Attorney, Agent, or Firm*—James A. Hinkle

[57] ABSTRACT

A tip on a conical bottom of a conical-bottom vial fits snugly in a receptacle in a central portion of a base. The base can be attached to the conical bottom for use as a stand for the vial. The tip is generally truncate-spherical. An entrance to the receptacle is flexible and resilient to contain the tip with resistance to a designed amount of pulling force. Base walls comprised of a flexible and resilient material on an outside periphery of the base are extended from the base to a position of contact with an outside periphery of a top portion of the conical bottom. The base walls maintain the vial concentric with the base. The vial is attachable to the base by inserting the tip into the receptacle with the base held concentric to the vial. A vial with a bulb tip is separable most easily and quickly from the base by eccentric pivoting of the vial and the base. The base generally has an outside periphery that has the same circumference as an outside periphery of the vial. In addition, the base can be sized and shaped to position the vial as desired in relation to automated or manual laboratory equipment.

10 Claims, 2 Drawing Sheets

FIG. 4
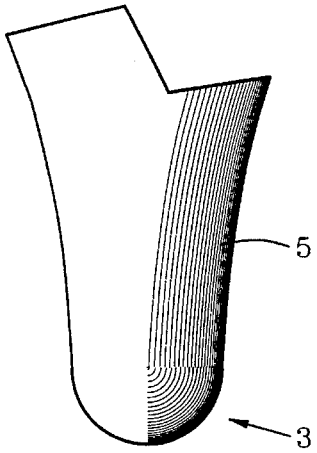
FIG. 6
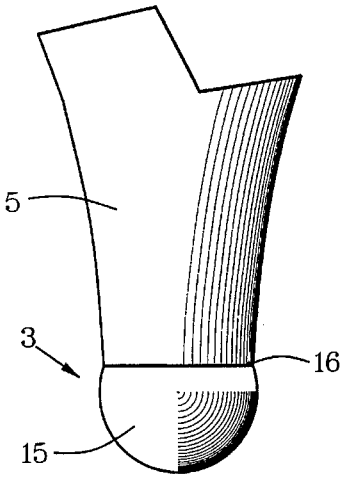
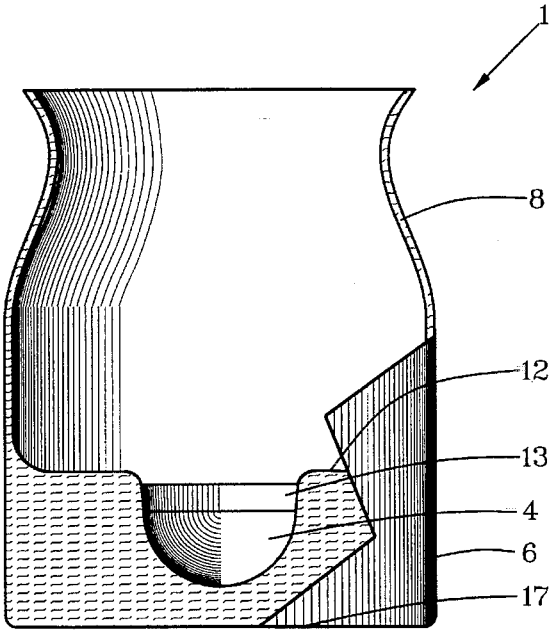
FIG. 5
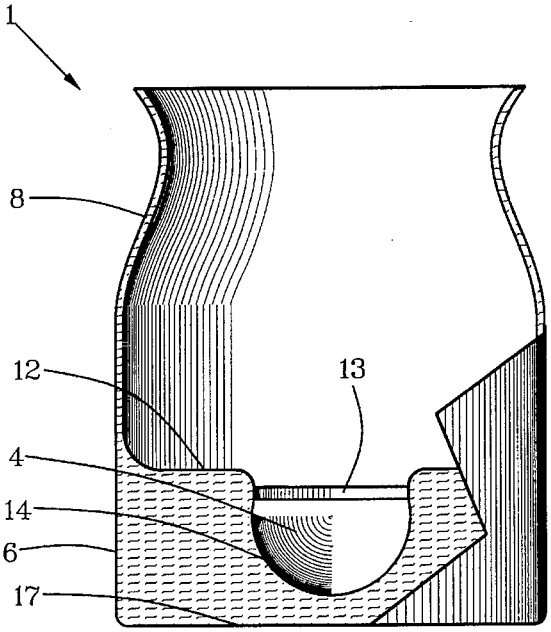
FIG. 7

SUPPORTING STAND FOR CONICAL-BOTTOM LIMITED-VOLUME VIAL

BACKGROUND OF THE INVENTION

I. Field of the Invention

The present invention relates generally to the field of chromatography vials. In particular, it is related to a base for holding and handling a vial having a conical bottom in use-conditions separate from trays for containing conical-bottom vials.

II. Description of the Prior Art

Conical bottoms are used generally on vials that are relatively small and referred to commonly as limited-volume vials. They are not large enough to have a base broad enough for support in an upright attitude and also to provide space for finger-grasping in addition to having a throat for laboratory work. The container body of such vials is typically about the size of a pencil that is only one-half inch long. The conical bottom and a throat to contain a septum make the entire vial about one and one-quarter inches long. The conical bottoms of such small vials are placed in trays that usually have a plurality of conical cups that support the vials in an upright position.

The only known means, however, for suitably standing the vials individually in an upright position when desired, is by placing the vials in a hollow tube. Equally missing has been a means for holding the small vials manually when working with them, observing substances in them, removing substances from them or placing additional substances in them with laboratory tools. The lack of handling capability for conical bottom vials has been particularly troubling to entities using chromatography auto-sampling instruments.

SUMMARY OF THE INVENTION

In accordance with the present invention, it is contemplated that in light of such problems that have existed and that continue to exist in this field, one objective of this invention is to provide a vial base that can be attached firmly to and yet removed quickly and easily from a vial with a conical bottom when desired.

Another objective is to provide a vial with a conical bottom that can be positioned in and held reliably by a base with which the vial can be supported in an upright position when desired.

Another objective is to provide a conical-bottom vial that is held reliably by a base that provides sufficient length for manual-grasping and tool-grasping when working with the vial.

Another objective is to provide a conical-bottom vial in combination with a base for positioning the vial in an upright position on automation equipment for grasping with automation equipment.

Another objective is to provide a conical-bottom vial with a base that has sufficient resilience to protect the vial when it may be dropped or otherwise mishandled.

Still another objective is to provide a conical-bottom vial with a base that will not be dislodged with ordinary handling, but instead requires special but convenient procedure for quick release and replacement when desired.

This invention accomplishes the above and other objectives with a vial having a tip on a conical bottom that fits snugly in a receptacle proximate a central portion of a base.

The base can be positioned on the conical bottom for use as a stand for the vial. The tip is generally truncate-spherical. An entrance to the receptacle is flexible and resilient to contain the tip with resistance to a designed amount of pulling force. Base walls comprised of a flexible and resilient material on an outside periphery of the base are extended from the base to a position of contact with an outside periphery of a top portion of the conical bottom. The base walls maintain the vial concentric with the base. The vial is attachable to the base by inserting the tip into the receptacle with the base held concentric to the vial. A vial with a bulb tip is separable most easily and quickly from the base by eccentric pivoting of the vial and the base. Side pressure for leverage-pivoting to separate the bulb tip from the base when desired is not encountered in conditions of use of the vial when attached to the base. The base generally has an outside periphery that has a circumference the same as an outside periphery of the vial. In addition, the base can be sized and shaped to position the vial as desired in relation to automated or manual laboratory equipment.

Other objects, advantages and capabilities of the invention will become apparent from the following description taken in conjunction with the accompanying drawings showing preferred embodiments of the invention.

BRIEF DESCRIPTION OF THE DRAWINGS

FIG. 4 is a sectional side view of a conical bottom with a hemispherical tip;

FIG. 5 is a cutaway side view of a base in which the FIG. 4 tip fits;

FIG. 6 is a sectional side view of a conical bottom with a truncate-sperical-bulb tip; and FIG. 7 is a cutaway side view of a base in which the FIG. 4 tip fits.

DESCRIPTION OF THE PREFERRED EMBODIMENTS

Figure 1:
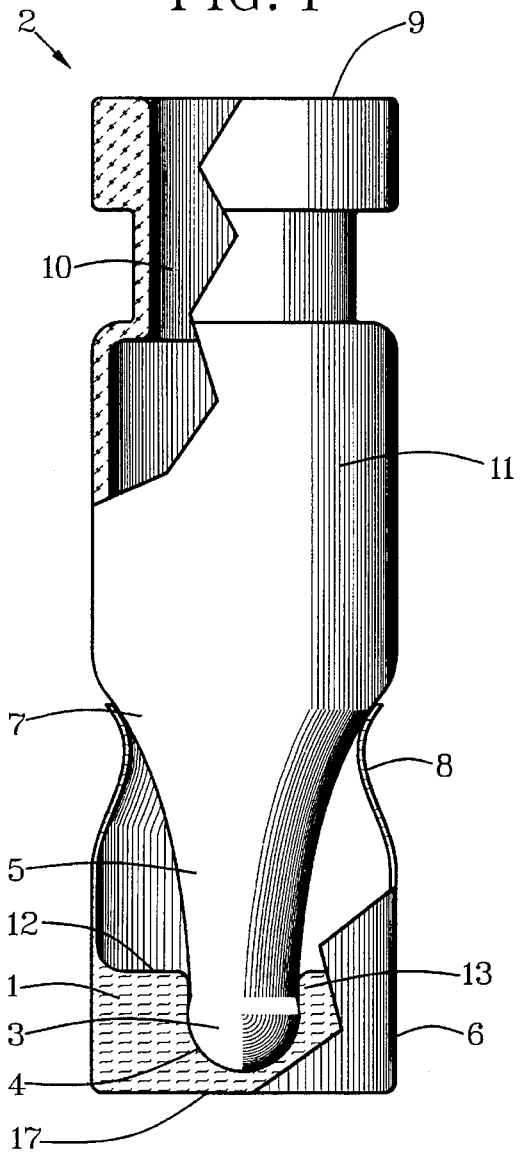
FIG. 1 is a cutaway elevation view of a conical-bottom vial in a base.
Figure 2:
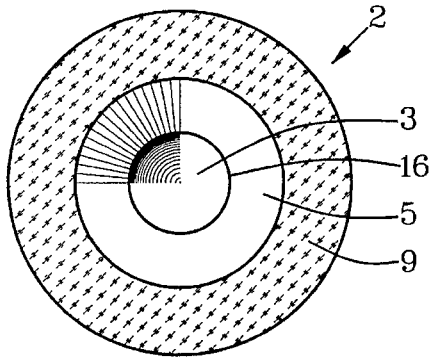
FIG. 2 is a top view of a conical-bottom vial.
Figure 3:
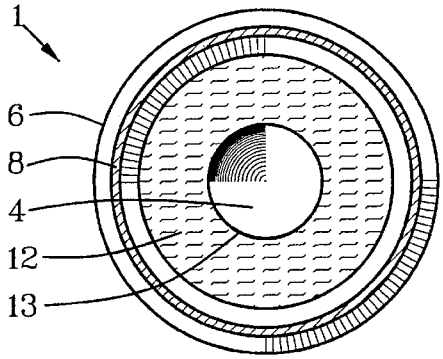
FIG. 3 is a top view of a base.

Referring to the drawings wherein like reference numerals designate corresponding parts throughout the several figures, reference is made first to FIGS. 1–3. A base 1 is attachable to a conical-bottom vial 2 by insertion of a tip 3 into a tip receptacle 4 of a conical bottom 5 that is positioned centrally in the base 1. Extended upward perpendicularly from an outside periphery 6 of the base 1 to snug contact with a top portion 7 of the conical bottom 5 is a base wall 8. The base 1, the base wall 8 and an inside periphery of the tip receptacle 4 are preferably flexible and resilient. The conical-bottom vial 2 has a vial top 9 at an entrance to a throat 10 leading to an inside periphery of vial body 11. An inside periphery of the conical-bottom vial 2 is generally hollow from the throat 10 to an inside periphery of the tip 3 as illustrated in FIGS. 1 and 2. The base 1 has an inside platform 12 intermediate the tip receptacle and an inside periphery of the base wall 8 as illustrated in FIGS. 1, 3, 5 and 7. The base wall 8 is preferably tapered and curved to provide designed flexibility and resilience of support for the conical bottom 5. At an entrance to the tip receptacle 4, there is a receptacle rim 13 that has a width designed in relation to its flexibility and resilience to hold a tip with desired gripping effect. Illustrated in FIG. 1 is a receptacle rim 13 that is relatively wide.

Referring to FIGS. 4 and 5, the tip 3 is variously rounded, arcuate or hemispherical for use conditions requiring relative ease of insertion into and removal from the tip receptacle 4. For such use conditions, the receptacle rim 13 is preferably wide as shown in FIG. 1 or slightly narrower as shown in FIG. 5. Also, the receptacle rim 13 can be tapered to match taper of conical bottoms 5 proximate with the tip 3.

Referring to FIGS. 6 and 7, a truncate-spherical bottom 14 below the receptacle rim 13 is provided to snap-lock onto a truncate-spherical tip 15 for use conditions requiring relatively sturdy attachment of the base 1 to the vial 2. Conical-bottom vials 2 with or without the truncate-spherical tip 15 can be used with bases 1 having a truncate-spherical bottom 14.

Attachment of a base 1 having a truncate-spherical bottom 14 to a conical-bottom vial 2 having a truncate-spherical tip 15 can be accomplished by merely pushing them together with their axes in line concentrically. Separating them, however, can be made desirably difficult to avoid inadvertent separation. Flexibility of the receptacle rim 13 and size of a minor diameter of the truncate-spherical tip 15 at a juncture 16 are primary factors for design of holding power of a snap-fit of the truncate-spherical tip 15 into the truncate-spherical bottom 14. An objective of this snap-fit is to prevent separation resulting from the most severe use conditions. Although attachments of either type can be relatively permanent during the use-life of a conical-bottom vial 2, the snap-fit type is most permanent.

The snap-fit, however provides a quick-release attachment with a procedure that would not occur in use conditions. The vial body 11 is used as a class-1 lever on the receptacle rim 13 as a fulcrum point to leverage the truncate-spherical tip 15 against an opposite side of the receptacle rim 13. This is achieved with eccentric pivoting of the vial body 11 in relation to the base 1. The truncate-spherical tip 15 is removed easily and quickly in this manner, even though it could be made difficult to be removed by pulling the vial body 11 away from the base 1.

The truncate-spherical tip 15 need not be precisely truncate-spherical. This term is intended to describe a generally rounded or arcuate bulb on the end of the conical bottom 5. An arcuate form with different or equal curvature on opposite sides of a major diameter of a bulb is included within the intended meaning of the term "truncate-spherical tip 15".

A base bottom 17 has preferably the same diameter or width as the vial body 11 for most use conditions. In the typical applications the total vial and base length will be 32 mm with a 12 mm diameter. Without the base of the present invention, the vials are not free standing. In order for a sampling needle of an auto-sampler to access the throat of the vial 2, the vial needs to be standing upright to receive the needle. Hence, the need for the base 1. Further, some auto-samplers push up from the bottom to position the vial in operative relation with the sampling needle and this requires a large flat bottom surface of base 1. Design of the base 1 to use a small, conical-bottom vial 2 interchangeably with larger vials on automated laboratory equipment is particularly advantageous for high-volume sampling from vials too small for most automated equipment.

Various modifications may be made of the invention without departing from the scope thereof and it is desired, therefore, that only such limitations shall be placed thereon as are imposed by the prior art and which are set forth in the appended claims.

What is claimed is:

1. A combination limited-volume vial and base stand comprising:

an elongated rigid vial having a proximal end and a distal end, the distal end having a tapered conical configuration of a predetermined minimum cross-sectional diameter, the distal end terminating in a truncated spherical tip, the spherical tip having a cross-sectional diameter greater than the minimum cross-sectional diameter of the distal end, a base made of resilient material to receive the spherical tip of the vial, the base having a flat external bottom and an upper platform surface defining a predetermined thickness therebetween, the base having an upstanding cylindrical wall extending from the bottom defining a substantially hollow interior cavity to accept the distal end of the vial, the upper platform surface of the base defining a tip receptacle cavity within the upper platform surface to receive the vial tip centrally therein, and the tip receptacle cavity being of a corresponding size and shape to that of the vial tip to receive the vial tip in a snap fit relationship to maintain the vial and base together as a separable unitary structure.

2. A combination limited-volume vial and base stand as claimed in claim 1, wherein the vial is cylindrical.

3. A combination limited-volume vial and base stand as claimed in claim 2, wherein the base stand is cylindrical.

4. A combination limited-volume vial and base stand as claimed in claim 3, wherein the upstanding cylindrical wall has an annular top rim, the top rim being juxtaposed against the tapered distal end of the vial.

5. A combination limited-volume vial and base stand as claimed in claim 4, wherein the cylindrical wall top rim is flexible and conforms to the shape of the tapered distal end of the vial when placed in juxtaposition with the distal end.

6. A combination limited-volume vial and base stand as claimed in claim 5, wherein the tip receptacle cavity has an internal periphery with a hemispherical bottom.

7. A conical-bottom-vial base stand for receiving a vial having a tapered distal end of a predetermined minimum cross-sectional diameter which terminates in a truncated spherical tip wherein said tip has a cross-sectional diameter great than the minimum cross-sectional diameter of the distal end, and further comprising:

a base stand made of resilient material, the stand having a flat external bottom and an upper platform surface defining a predetermined thickness therebetween, the base stand having an upstanding cylindrical wall extending from the bottom defining a substantially hollow interior cavity to accept the distal end of the vial, the upper platform surface of the base defining a tip receptacle cavity within the upper platform surface to receive the vial tip centrally therein, the tip receptacle cavity having an internal periphery with a hemispherical bottom, the tip receptacle cavity being of a corresponding size and shape to that of the vial tip to receive the vial tip in a snap fit relationship.

8. A conical-bottom-vial base stand as claimed in claim 7, wherein the base stand is cylindrical.

9. A conical-bottom-vial base stand as claimed in claim 8, wherein the upstanding cylindrical wall has an annular top rim.

10. A conical-bottom-vial base stand as claimed in claim 9, wherein the cylindrical wall top rim is flexible and conforms to the shape of the tapered distal end of the vial.

* * * * *